US010119543B2

(12) United States Patent
Khan et al.

(10) Patent No.: US 10,119,543 B2
(45) Date of Patent: Nov. 6, 2018

(54) PUMP PRIMING ASSEMBLIES

(71) Applicant: Generac Power Systems, Inc., Waukesha, WI (US)

(72) Inventors: Mir Khan, Kenosha, WI (US); Alexander Kobryn, Deerfield, WI (US); Whitney Montondo, Waukesha, WI (US); Nic Saeger, Pewaukee, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 319 days.

(21) Appl. No.: 14/934,876

(22) Filed: Nov. 6, 2015

(65) Prior Publication Data

US 2016/0131140 A1 May 12, 2016

Related U.S. Application Data

(63) Continuation-in-part of application No. 29/508,574, filed on Nov. 7, 2014, now Pat. No. Des. 750,139.

(60) Provisional application No. 62/076,772, filed on Nov. 7, 2014.

(51) Int. Cl.

| | |
|---|---|
| ***F04D 9/00*** | (2006.01) |
| ***F04D 1/00*** | (2006.01) |
| ***F04D 13/02*** | (2006.01) |
| ***F04D 29/22*** | (2006.01) |
| ***F04D 29/42*** | (2006.01) |
| ***F04D 29/62*** | (2006.01) |

(52) U.S. Cl.

CPC ..... *F04D 9/006* (2013.01); *F04D 13/02* (2013.01); *F04D 29/4293* (2013.01)

(58) Field of Classification Search

CPC . F04D 9/004; F04D 9/006; F04D 9/04; F04D 9/041; F04D 9/043; F04D 13/02; F04D 29/4293; F04D 29/2205; F04D 29/628

See application file for complete search history.

(56) References Cited

U.S. PATENT DOCUMENTS

| | | | | |
|---|---|---|---|---|
| 2,033,981 A * | 3/1936 | Durdin, Jr. | ..... | F04D 9/041 137/179 |
| 3,091,184 A | 5/1963 | Wood | | |
| 3,252,576 A | 5/1966 | Miller | | |
| 3,434,430 A * | 3/1969 | Berman | ..... | F04D 9/008 137/115.13 |
| 3,620,372 A | 11/1971 | Ehret | | |

(Continued)

OTHER PUBLICATIONS

PumpStop, Jan. 6, 2012, http://www.overheatprotection.com, available at https://web.archive.org/web/20120106025909/http://overheatprotection.com*

*Primary Examiner* — Igor Kershteyn
(74) *Attorney, Agent, or Firm* — Boyle Fredrickson, S.C.

(57) ABSTRACT

An assembly for indicating and communicating a priming charge to a fluid pump to establish self-sustained operation of the fluid pump is disclosed. The priming assembly includes an enlarged inlet associated with a fluid priming chamber and an outlet that is in fluid communication with the working fluid passage associated with the pump. The priming assembly includes one or more of a cap or valve assembly associated with isolating the pump chamber from atmosphere and preferably includes indicia associated with use and/or operation of the priming assembly.

14 Claims, 16 Drawing Sheets

(56) References Cited

U.S. PATENT DOCUMENTS

| | | | | |
|---|---|---|---|---|
| 3,726,618 | A * | 4/1973 | Dicmas | F04D 9/005 415/11 |
| 3,910,840 | A | 10/1975 | Adam | |
| 4,348,281 | A | 9/1982 | Perry | |
| 4,678,001 | A | 7/1987 | Lacey | |
| 4,690,613 | A * | 9/1987 | Eberhardt | F02B 63/06 251/315.08 |
| 4,725,352 | A | 2/1988 | Haliotis | |
| 4,737,279 | A | 4/1988 | Lewis | |
| 5,154,821 | A | 10/1992 | Reid | |
| 5,860,793 | A | 1/1999 | Muscarella et al. | |
| 6,187,181 | B1 | 2/2001 | Stoltz | |
| 6,536,467 | B2 | 3/2003 | Wu et al. | |
| 6,716,342 | B1 | 4/2004 | Tilsner | |
| D505,681 | S | 5/2005 | Rossman et al. | |
| D604,800 | S | 11/2009 | Vreeland | |
| D620,999 | S | 8/2010 | Vreeland | |
| D623,201 | S | 9/2010 | Yu | |
| 7,815,795 | B2 | 10/2010 | Parks et al. | |
| 8,091,934 | B2 | 1/2012 | Bair | |
| 8,439,069 | B2 * | 5/2013 | Yeater | F04D 9/006 137/115.06 |
| D694,851 | S | 12/2013 | Solakian | |
| D694,852 | S | 12/2013 | Gordon | |
| 8,814,531 | B2 | 8/2014 | Raasch | |
| 2009/0016901 | A1 | 1/2009 | Morris | |

* cited by examiner

PUMP PRIMING ASSEMBLIES

CROSS-REFERENCE TO RELATED APPLICATIONS

This application is a non-provisional patent application and claims priority to U.S. Provisional Patent Application Ser. No. 62/076,772 filed on Nov. 7, 2014 titled PUMP PRIMING ASSEMBLIES and U.S. Design patent application Ser. No 29/508,574 filed on Nov. 7, 2014 titled WATER PUMP PRIMER BODY and the disclosures of which are expressly incorporated herein.

FIELD OF THE INVENTION

The present invention is directed to assemblies that facilitate priming and maintaining a primed condition of the pump during operation of fluid pumps.

BACKGROUND AND SUMMARY OF THE INVENTION

When starting a centrifugal water pump powered by an internal combustion engine or other power source, the pump must first be filled with fluid, such as water, to initiate the fluid moving cycle. Such a practice is commonly referred to as priming the pump or pump priming. Pump priming is an important step for fluid pump startup procedures but it is also a frequently forgotten step. Lack of the initial water or fluid charge in the pump can result in damage to pump components, such as seals or the like, and is frequently attributable to overheating conditions associated with service life and operation of the pump. Pump performance and longevity can also be severely impacted if the pump is operated under an improperly primed condition. Accordingly, operation of fluid pumps without adequate priming conditions can cause high product return rates, warranty issues, and user dissatisfaction due to the unwanted and undesired damage and/or perceived improper function of the pump assembly. As pump priming is not an intuitive step even for frequent users of such devices, communicating the need to prime the pump before starting in a more intuitive manner than via user manuals, instructions, and/or hand tags, etc. would be desirable.

Further, the orifice associated with the priming activity is customarily small, frequently only approximately one inch in diameter, and is filled by a bucket or other portable reservoir. When pouring water into the priming passage, a significant quantity of water can spill over the sides, over the pump, and onto the ground rather than into the pump housing. Additionally, many such systems include a bung or similar plug structure that obstructs the priming opening during operation of the pump. A tool is commonly required to effectuate removal and insertion of the plug with respect to the pump housing between each priming and pump operating condition. Due to the generally small volume associated with the priming passage, it can also periodically be necessary to repeatedly prime a pump before the pump can achieve a condition of maintaining a self-sustained operating condition associated with movement of fluid in a desired manner. Accordingly, there is a desire to provide a pump priming assembly that is intuitive to operate, provides an obvious indication associated with the priming activity, is easy to operate, and can achieve the desired self-sustained operation of the pump device with a single priming activity.

The present invention discloses various pump priming arrangements or assemblies that resolve one or more of the shortcomings disclosed above. One aspect of the invention includes a pump priming assembly that enlarges the opening into a funnel or similar enlarged shape fill area at the pump so that water can be added to the pump more easily and such that the priming step is visually called out. In those configurations that include a removable cap, ease of associating the bung or cap with the opening is enhanced via the use of coarse threads. In other operable arrangements a limited turn, such as a quarter turn actuator, handle, or lever, etc., is provided to allow selective fluid connectivity between the volume associated with the priming assembly and the operating volume associated with the working fluid path associated with operation of the pump. Various aspects of the present invention include features associated with addressing and resolving the issue of potential damage to the pump due to improper priming conditions and/or insufficient fluid flow through the pump assembly.

One aspect of the invention discloses a priming assembly for use with portable pump assemblies. The priming assembly includes a body having a first end that is constructed to cooperate with a pump housing of a portable pump and a second end that is offset from the first end. A chamber is defined by the body and extends between the first end and the second end of the body. The chamber is defined by a cross-sectional area associated with the first or pump facing end of the body that is less than a cross-sectional area of the chamber associated with the second or fill end of the body.

Another aspect of the invention discloses a power driven pump assembly that includes a pump housing and an impeller that is disposed in the pump housing. The impeller is configured to communicate a working fluid along a working fluid path from a working fluid inlet toward a working fluid outlet during operation of the impeller. A priming chamber is configured to be in fluid communication with the working fluid path and is defined by a priming passage inlet that has a larger cross section area than a priming passage outlet associated with communicating a priming fluid to the working fluid path associated with the impeller.

A further aspect of the invention discloses a method of forming a power driven pump assembly that includes providing a pump defined by a pump housing that defines a pump chamber and that substantially encloses an impeller configured to communicate a working fluid from a working fluid inlet to a working fluid outlet during operation of the impeller. A priming charge passage is provided that is configured to communicate a fluid priming charge to the pump chamber for priming the pump and is defined by a priming charge inlet that has a larger cross section area than an outlet of the priming charge passage.

These and other aspects and features of the invention will be further understood from the drawings and the following brief and detailed description of the drawings.

BRIEF DESCRIPTION OF THE DRAWINGS

The drawings illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

The various features and advantageous details of the subject matter disclosed herein are explained more fully with reference to the non-limiting embodiments described in detail in the following description.

Figure 1:
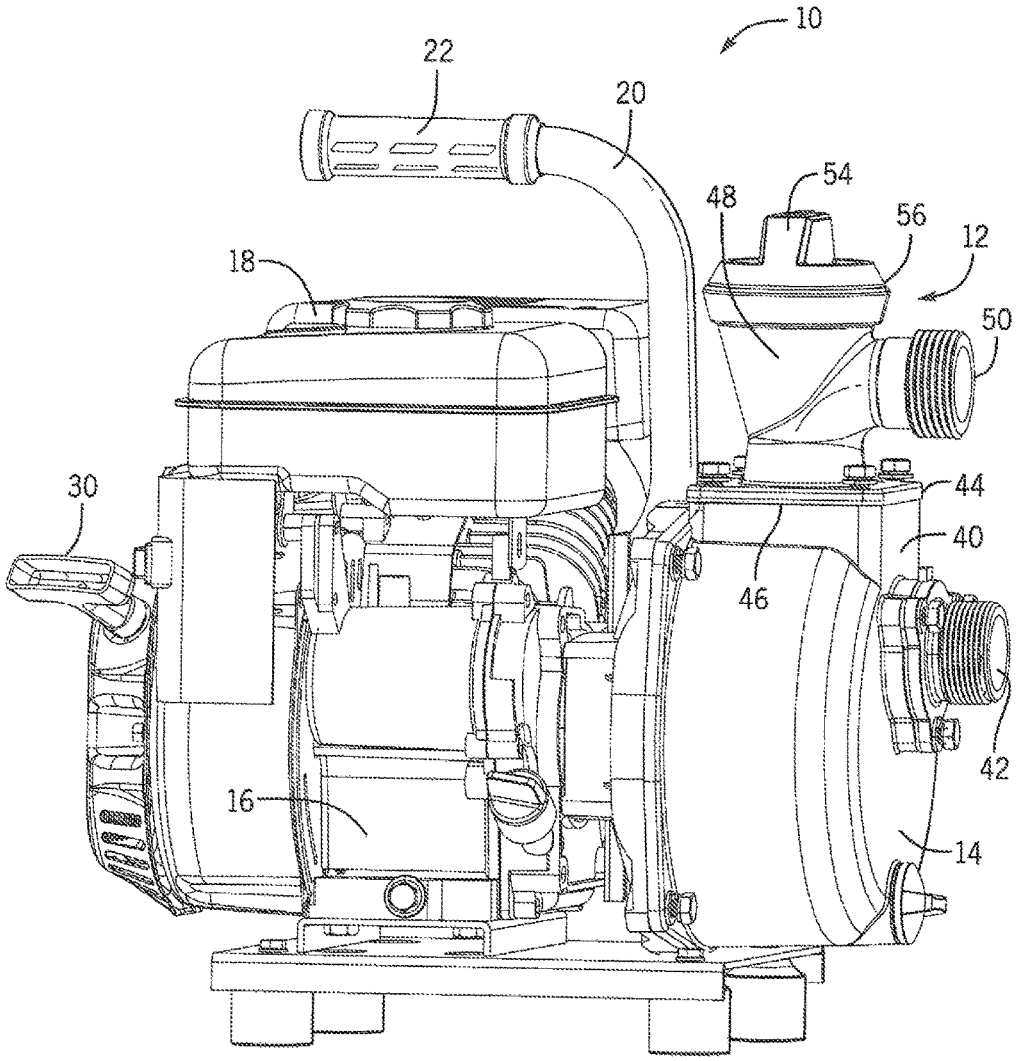
FIG. 1 is a perspective view of an exemplary portable pump assembly that includes a priming assembly according to one embodiment of the invention.
Figure 2:
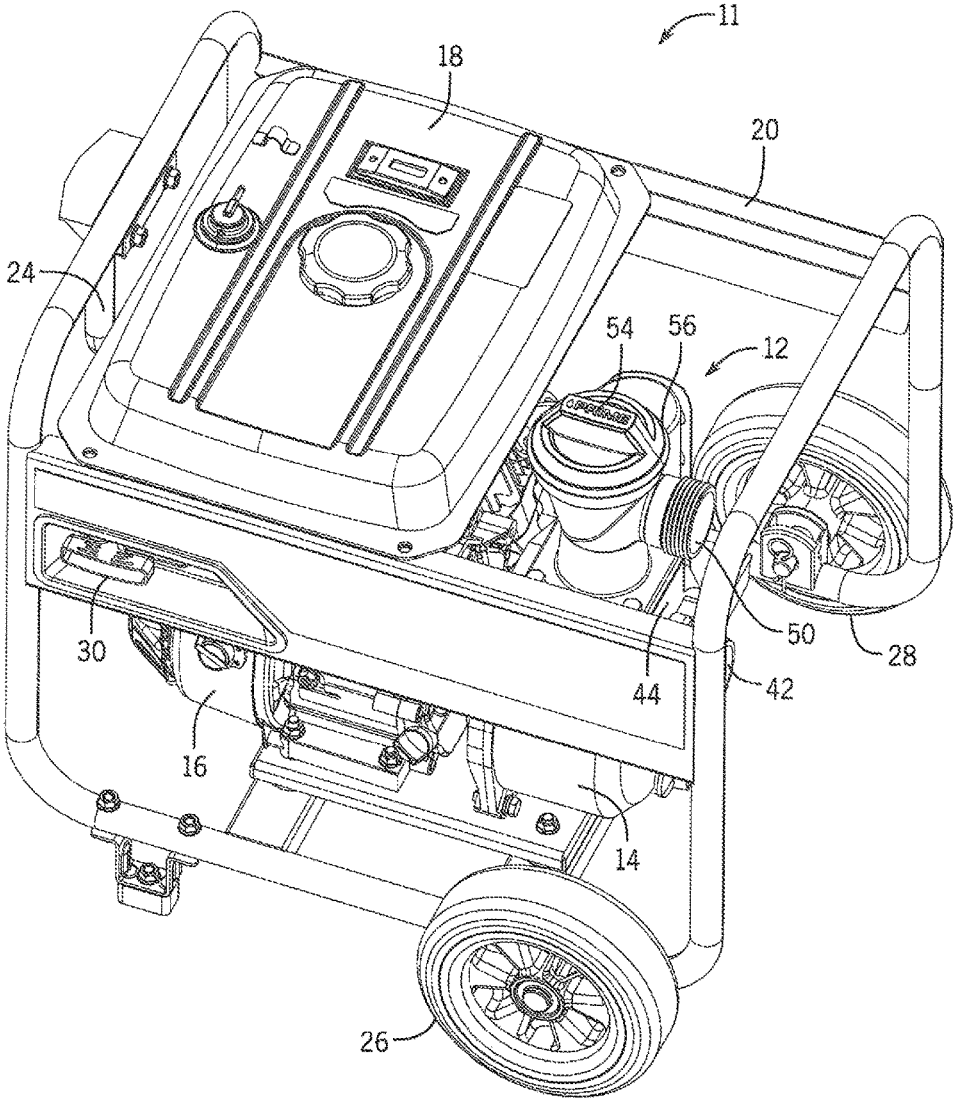
FIG. 2 is a view similar to FIG. 1 of the priming assembly shown therein associated with another exemplary portable pump assembly.
Figure 3:
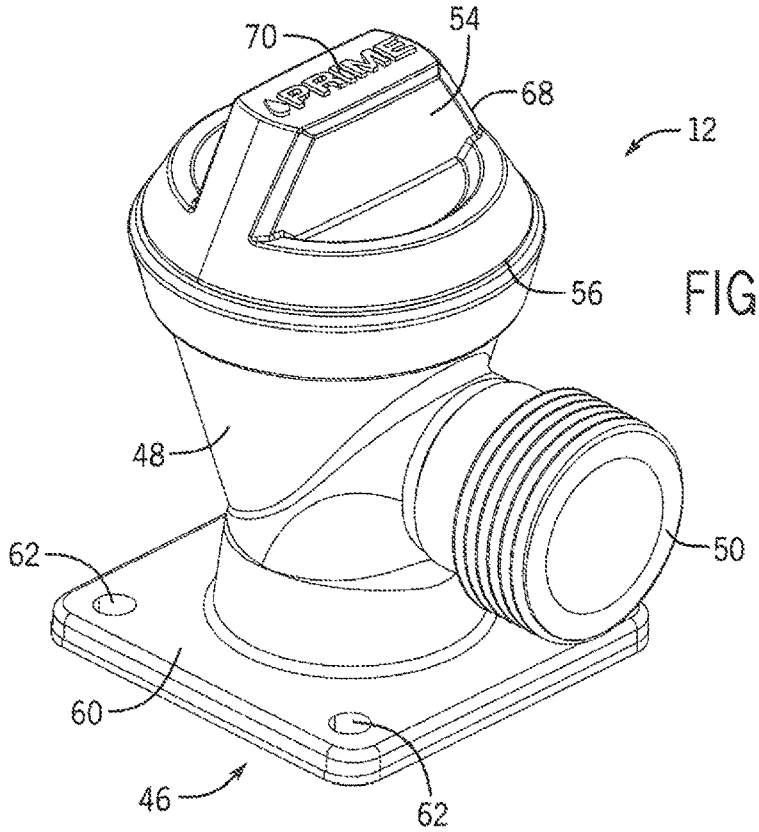
FIG. 3 is a perspective view of the priming assembly shown in FIGS. 1 and 2 removed from the respective underlying pump assemblies.
Figure 4:
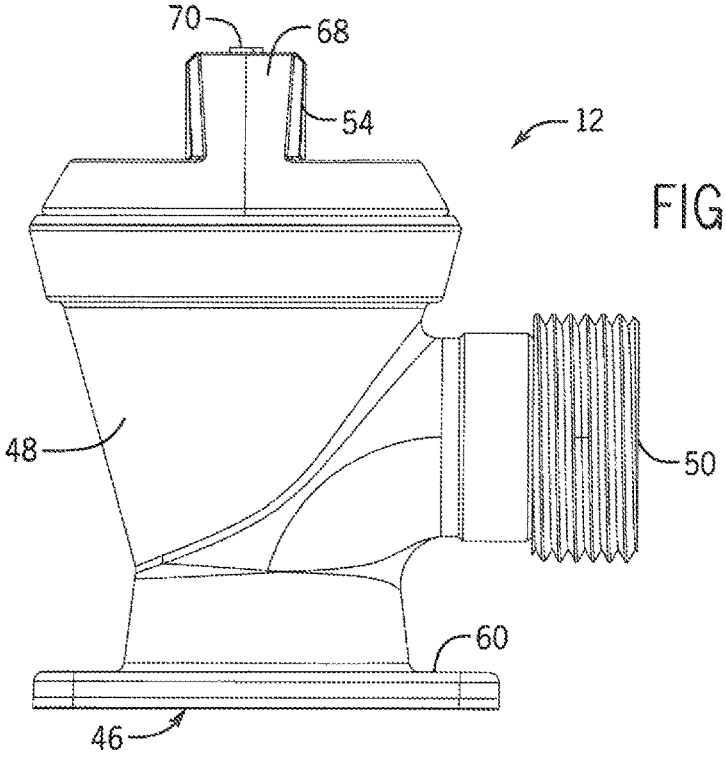
FIG. 4 is a left side elevation view of the priming assembly shown in FIG. 3.
Figure 5:
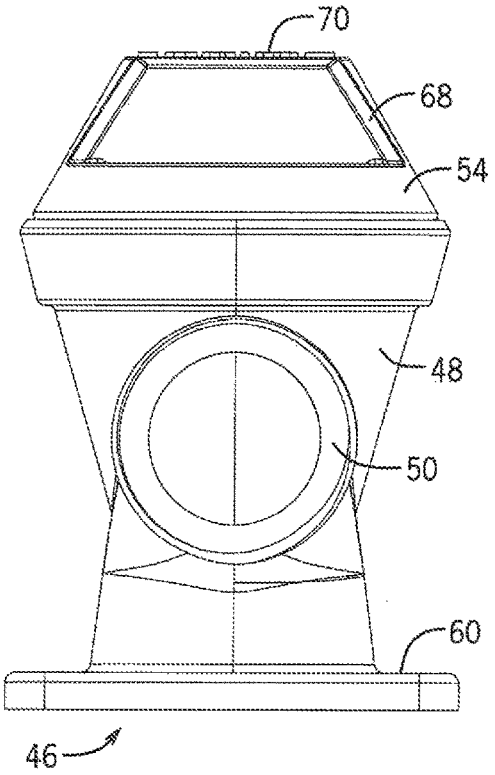
FIG. 5 is a front side elevation view of the priming assembly shown in FIG. 3.
Figure 6:
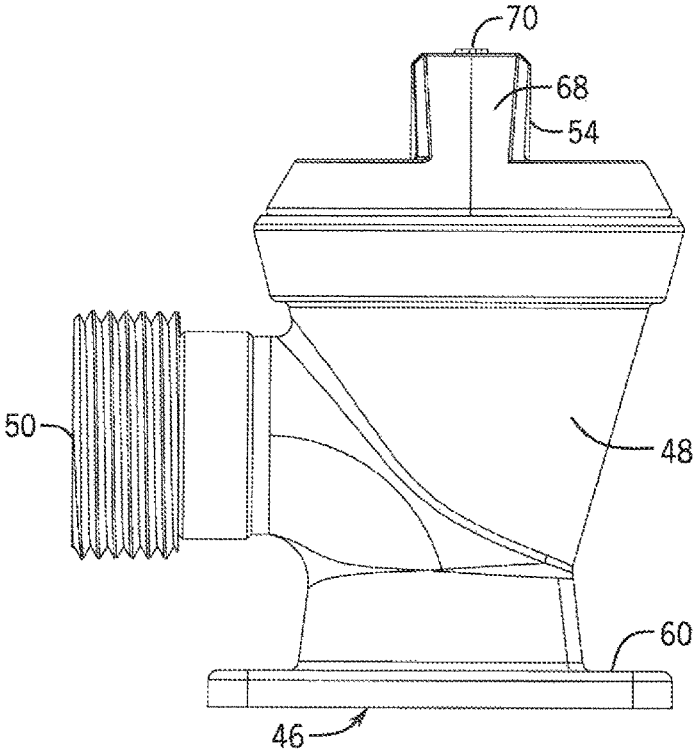
FIG. 6 is right side elevation view of the priming assembly shown in FIG. 3.
Figure 7:
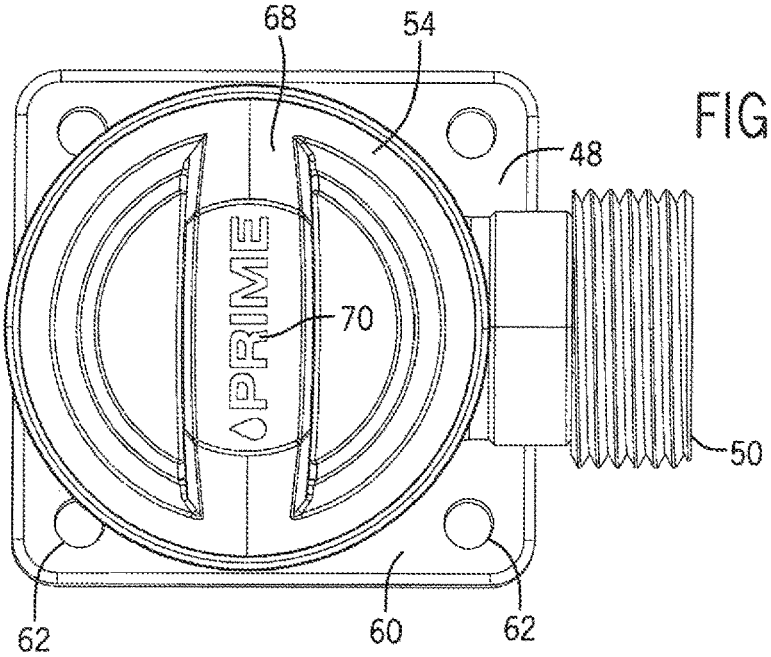
FIG. 7 is a top plan view of the priming assembly shown in FIG. 3.
Figure 8:
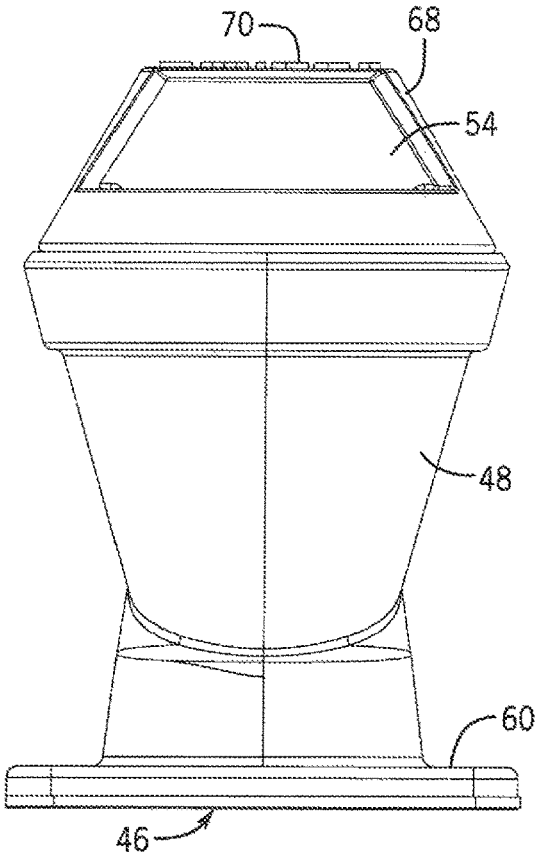
FIG. 8 is a rear side elevation view of the priming assembly shown in FIG. 3.

With reference to the accompanying figures. FIGS. 1 and 2 show portable pump assemblies 10, 11 which are each equipped with a pump prime assembly 12 according to a first aspect of the present invention. Each portable pump assembly 10, 11 includes a pump assembly or simply referred to as a pump 14 that is generally defined by a housing 40 configured to enclose an impeller. An internal combustion engine 16 is operationally connected to pump 14 such that operation of the internal combustion engine 16 effectuates rotation and/or driving operation of the impeller associated with pump 14. It is appreciated that the present invention is usable with pump assemblies associated with other power plants or drive devices such as a motor or the like. It is further appreciated that selective drive arrangements, such as a clutch or the like, can be provided between the respective power source, such as engine 16, and a shaft associated with the impeller to accommodate selective operation of the impeller during operation of the respective power source.

Still referring to FIGS. 1 and 2, a fuel source or tank 18 is operationally connected to internal combustion engine 16 to effectuate operation of the underlying internal combustion engine. A chassis or frame 20 preferably supports the pump assembly or pump 14 and internal combustion engine 16. Frame 20 can include one or more grip sites 22 (FIG. 1) and/or one or more handles 24, and/or wheels 26, 28 (FIG. 2) associated with transportation of the respective portable pump assembly 10, 11. It is further appreciated that internal combustion engine 16 can be configured as a manual start engine, as indicated by recoil handle 30, or provided in an electronic start configuration such as via inclusion of a starter and/or other electronic ignition system components and/or controls. It is further appreciated that an electric motor can be utilized to effectuate the drive power associated with operation of a respective pump assembly.

Housing 40 of pump 14 generally defines a working fluid passage inlet 42 and an outlet passage 44. In the configurations shown in FIGS. 1 and 2, outlet passage 44 associated with pump housing 40 is fluidly connected to a first passage opening 46 defined by a body or housing 48 of pump prime assembly 12. It is further appreciated that pump housing 40 and prime assembly housing 48 could be formed as a unitary assembly and that providing a pump prime assembly that can removably cooperate with an underlying pump assembly accommodates use of pump prime assembly 12 as a convenient add-on or retrofit for existing portable pump assemblies.

Housing 48 of pump prime assembly 12 defines an outlet or discharge opening 50 that is fluidly connectable to a cavity associated with pump housing 40 configured to contain the impeller associated with of pump 14 and communicates the working fluid flow to downstream devices or to atmosphere when portable pump assemblies 10, 11 are used to move a volume of fluid from one location to another. It is further appreciated that pump prime assembly 12 could be configured to cooperate with a prime inlet of existing pumps wherein the pump housing 40 defines the discharge outlet associated with operation of the pump assembly. Regardless of the orientation of the discharge outlet relative to the pump prime assembly housing or the pump housing, fluid inlet 42 and discharge opening 50 are each preferably constructed to removably cooperate with hoses or the like associated with the communicating the fluid to be moved to and from the portable pump assembly 10.

A cap or cover 54 removably cooperates with a prime opening 56 defined by housing 48 of pump prime assembly 12. During operation of portable pump assemblies 10, 11, operation of the impeller associated with pump 14 effectuates movement of the working fluid from inlet 42 associated with housing 40 of pump 14 and discharging the fluids via opening 50 associated with housing 48 of pump prime assembly 12. Cover 54 preferably cooperates with housing 48 of pump prime assembly 12 in a sealed manner and in a manner wherein cover 54 can be removed from and associated with housing 48 in a tool-less manner via a threaded or other mechanical connection methodology. When provided in as cooperating threaded surfaces, it is appreciated that the threaded interaction can be provided as a generally course or partial thread pattern to reduce the number of rotations associated with providing a secure but removable connection therebetween. It is further appreciated that other methodologies, such as a spring clip retainer assembly and/or a projection and channel association between cover 54 and housing 48, could be provided to effectuate the securable but removable connection between cover 54 and housing 48 of pump prime assembly 12.

Regardless of the relative orientation of the inlet and the outlet associated with moving the working fluid, the chamber associated with pump prime assembly 12 is fluidly connected to the work fluid path. As disclosed further below, it is appreciated that the entirety of, or only a portion of, the volume defined by the pump prime assembly can be selectively isolated from the working fluid flow paths—such as instances wherein a desired prime condition has been achieved and/or during self-sustained operation of the underlying pump 14.

Referring to FIGS. 3-10, housing 48 of pump prime assembly 12 includes a flange 60 that includes one or more openings 62 associated with securing pump prime assembly 12 to housing 40 of pump 14 such that inlet opening 46 associated with housing 48 of pump prime assembly 12 overlies the discharge opening or outlet passage 44 associated with pump housing 40. It is further appreciated that housing 48 of pump prime assembly 12 can be configured to cooperate with any number of discharge opening constructions associated with variations to pump housing constructions. Cover 54 is constructed to rotatably cooperate with prime opening 56 of housing 48 of pump prime assembly 12. Cover 54 includes a handle portion 68 that extends in a generally upward direction therefrom. Cover 54 also preferably includes at least one indicia 70 associated with providing an indication as to the required priming associated with achieving self-sustained operation of pump 14. Although shown as an alphanumeric indication, it is appreciated that indicia 70 could be provided in various forms including a readily observable and understandable graphic image, a color indication such as safety yellow or the like, etc., to provide the desired indication as to the priming function associated with utilization and/or operation of pump prime assembly 12.

Figure 9:
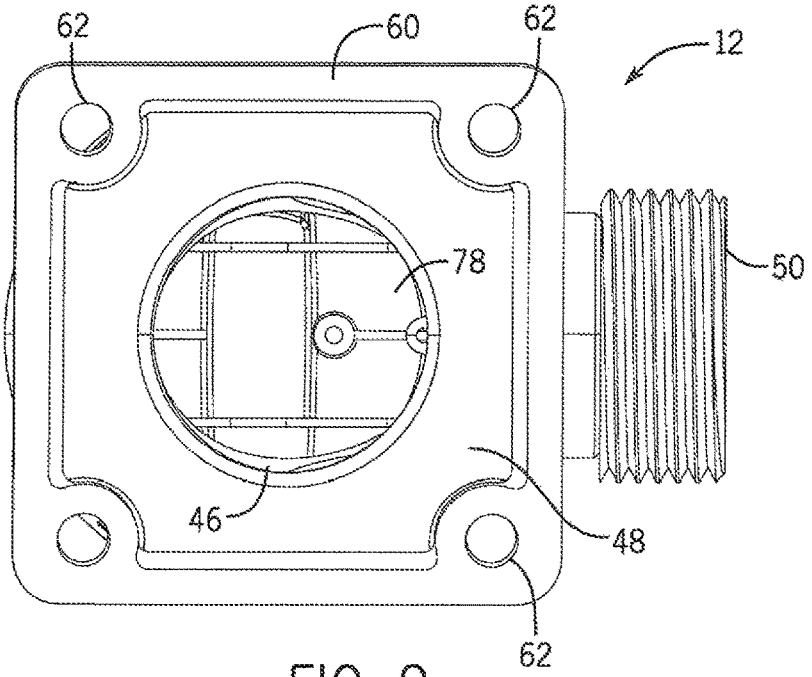
FIG. 9 is a bottom plan view of the priming assembly shown in FIG. 3.
Figure 10:
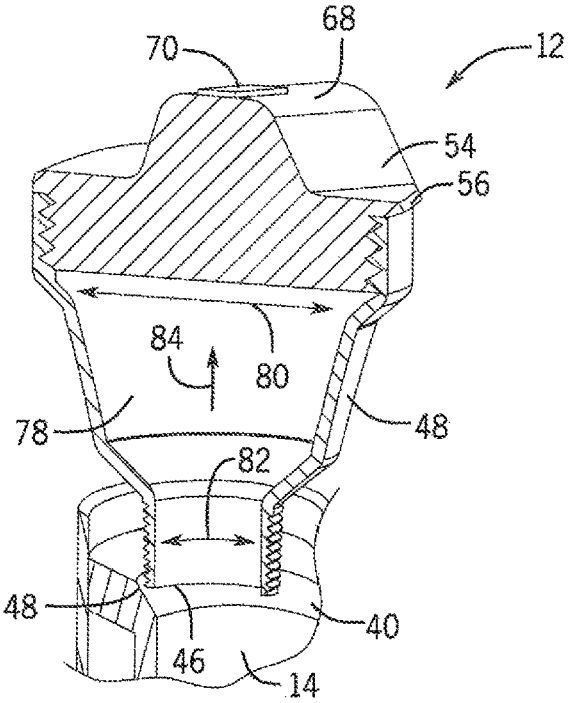
FIG. 10 is a graphical perspective cross section view of the priming assembly shown in FIG. 3 associated with an underlying pump.
Figure 11:
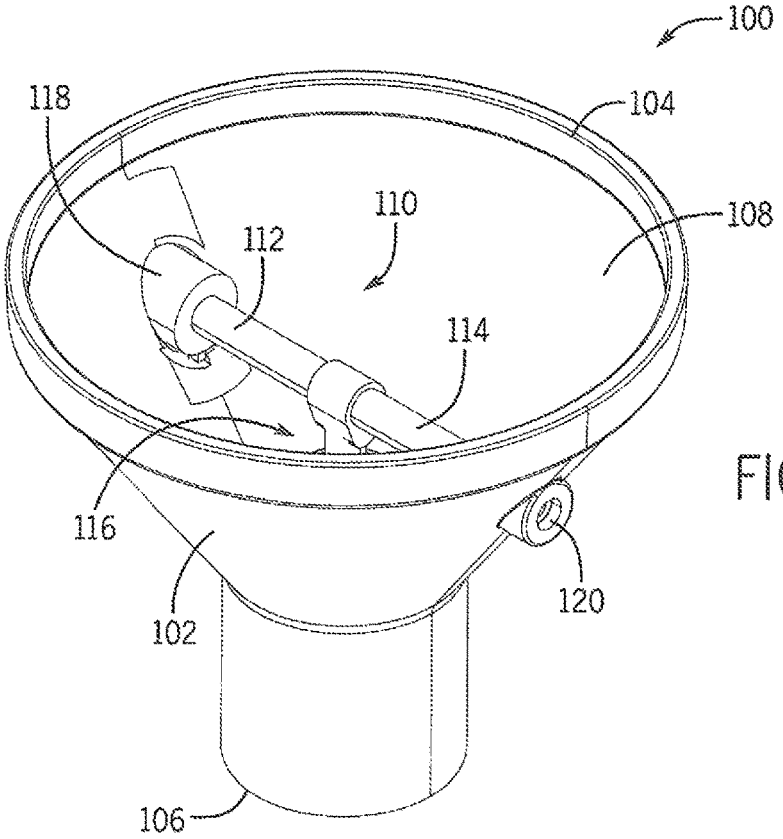
FIG. 11 is a perspective view of a priming assembly according to another embodiment of the invention and having a selectively operable valve assembly.
Figure 12:
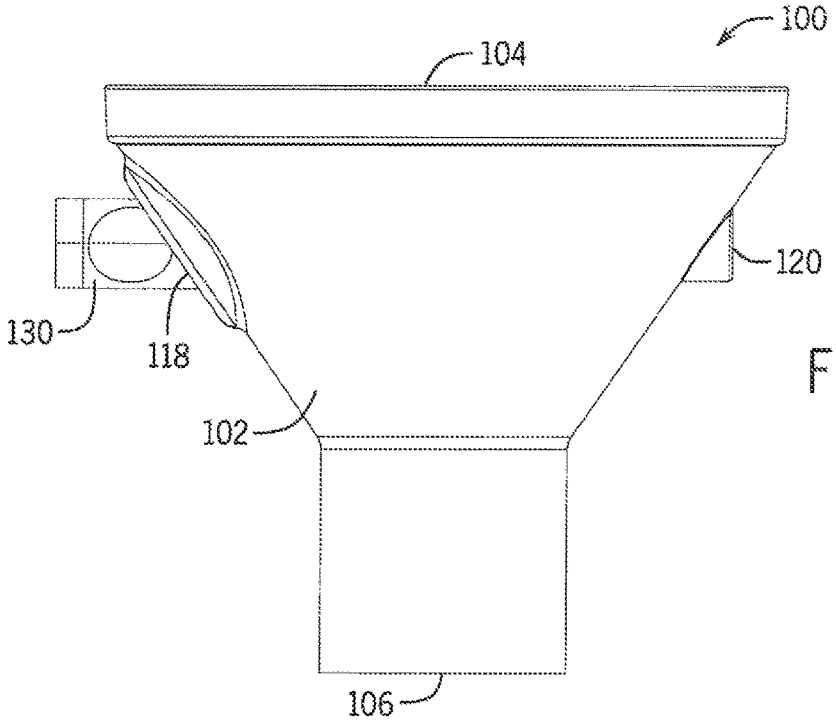
FIGS. 12-17 are side and plan views of the priming assembly shown in FIG. 11.
Figure 13:
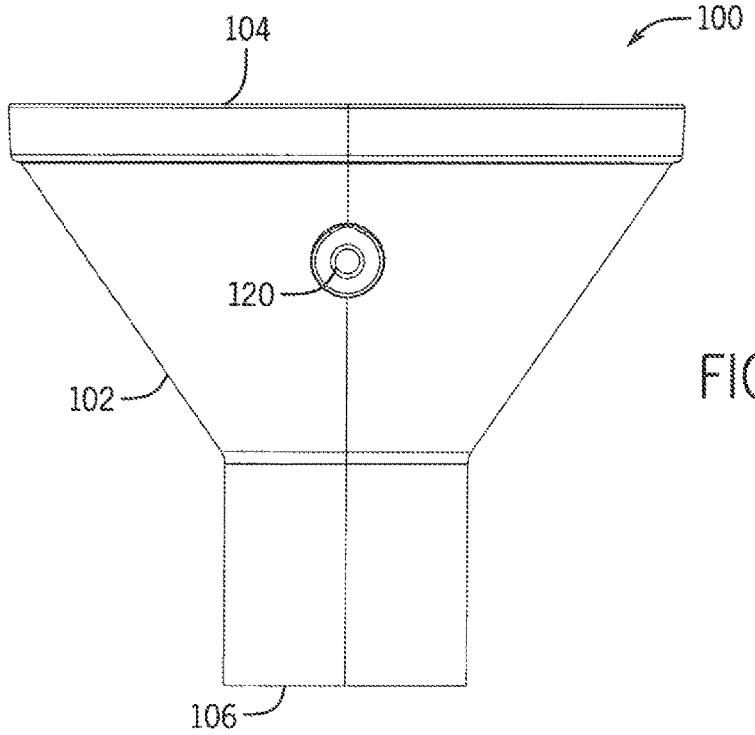
Figure 14:
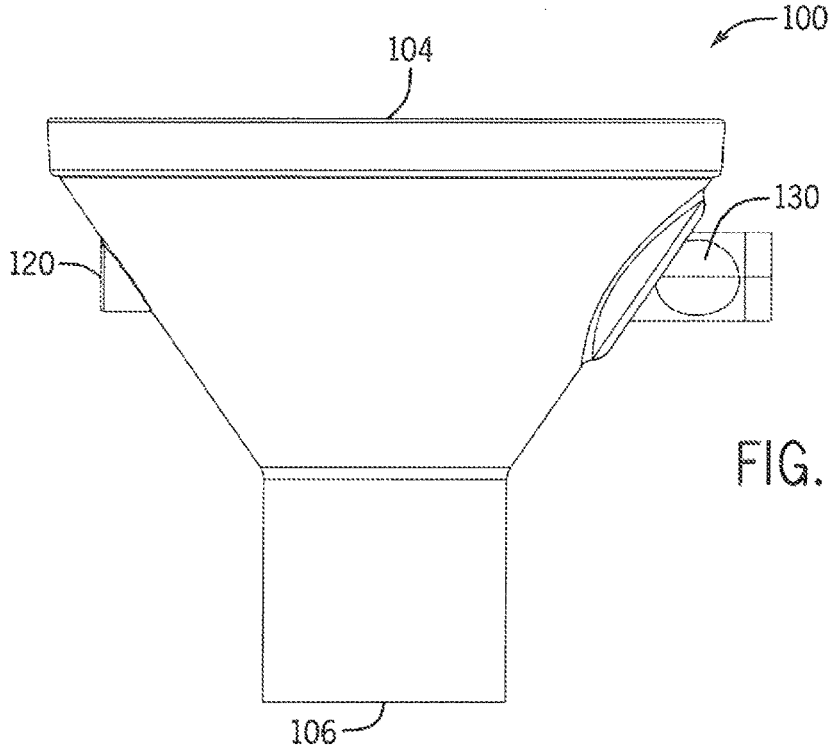
Figure 15:
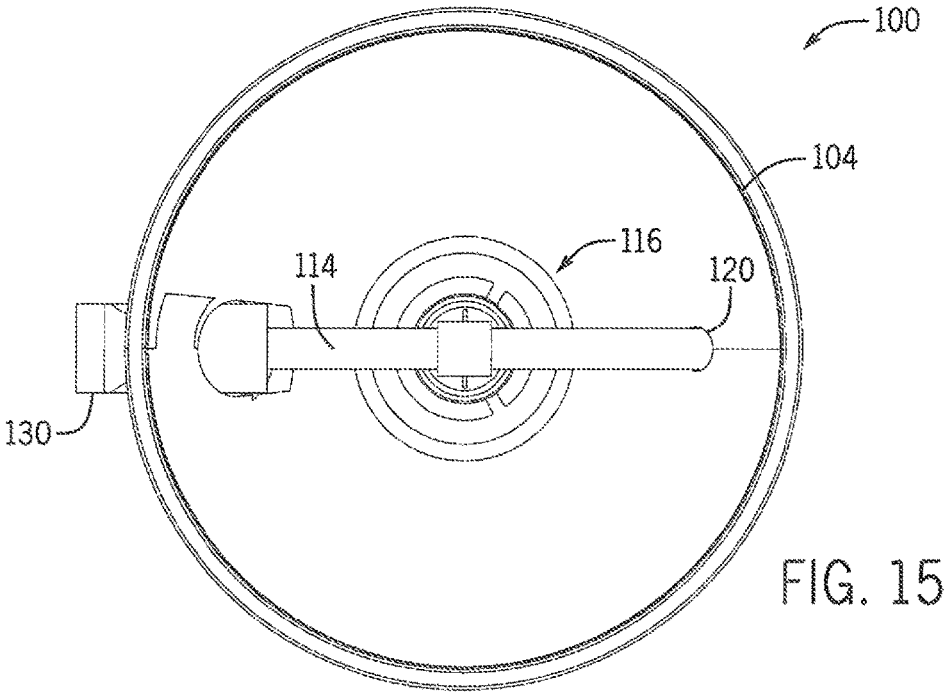
Figure 16:
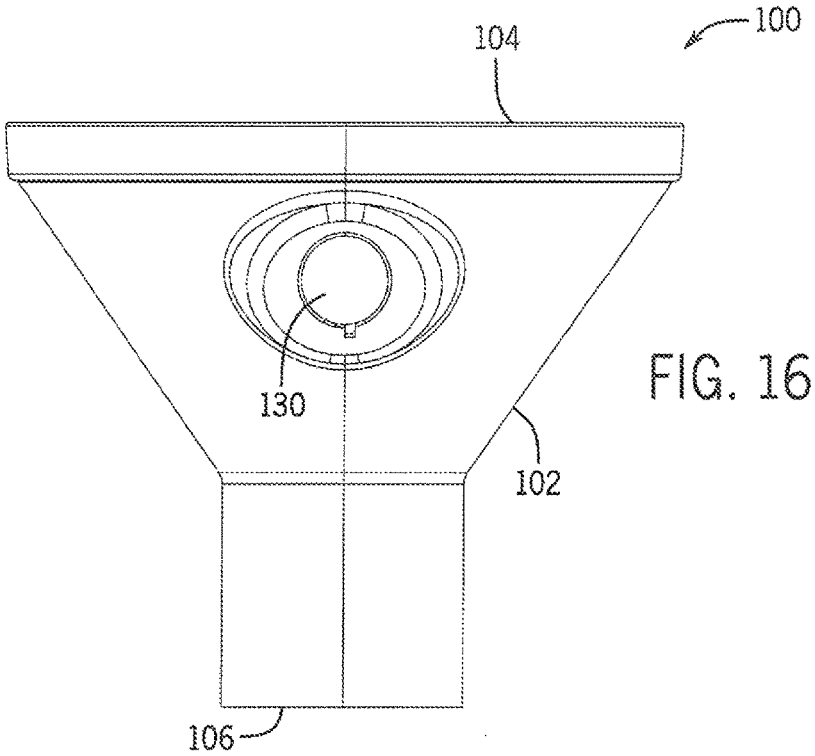
Figure 17:
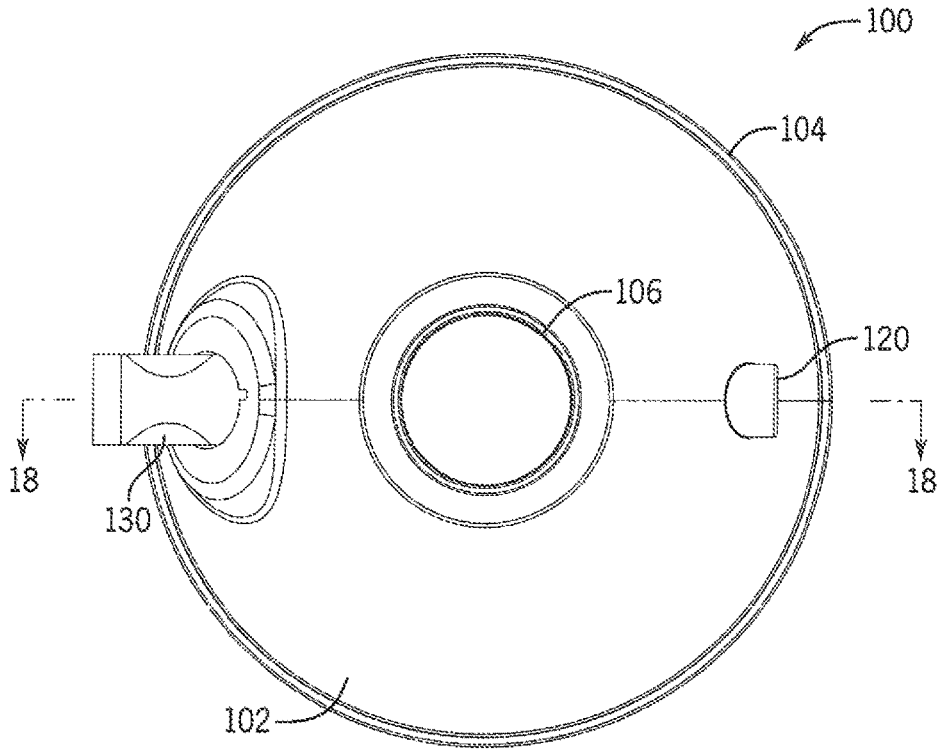

Referring to FIGS. 9 and 10, housing 48 of pump prime assembly 12 defines a chamber 78 associated with communicating the priming fluid between priming opening 56 and opening 46 associated with housing 48 of pump prime assembly 12. The cross-sectional area, indicated by arrow 80, associated with fill opening 56 is preferably greater than the cross-sectional area, indicated by arrow 82, associated with opening 46 of housing 48 of pump prime assembly 12. Said in another way, the cross-sectional area associated with chamber 78 of pump prime assembly 12 increases in an upward direction, indicated by arrow 84, toward opening 56 associated with housing 48. Preferably, a volume associated with chamber 78 of housing 48 of pump prime assembly 12 is sufficient to accommodate at least a portion of a volume of water associated with initial priming necessary for self-sustained operation of pump 14. The larger cross-sectional shape associated with opening 56 improves the efficiency with which the user can prime the pump and mitigates some of the detrimental consequences associated with small and limited accessible prime openings or passages disclosed above.

It is further envisioned that the volume associated with chamber 78 can be configured to provide a volume sufficient for multiple prime or at least partial prime activities associated with intermittent use or operation of the underlying portable pump assembly 10, 11. Regardless of the number of priming activities contemplated by the volume of chamber 78 associated with housing 48 of pump prime assembly 12, pump prime assembly 12 provides an opening 56 that is both more readily accessible and defines a larger footprint associated with the user's manual initial communication of the priming charge associated with operation of pump 14. Such considerations mitigate spillage and/or wetting of ancillary components associated with pump 14 and/or engine 16 as well as the surrounding areas and provides an intuitive indication as to the desired priming activity prior to operation of the respective portable pump assembly 10, 11.

FIGS. 11-19 disclose a pump prime assembly 100 according to another embodiment of the invention. Pump prime assembly 100 includes a housing 102 having an inlet end 104 and an outlet end 106. As used herein, it should be appreciated that the use of the terms "inlet" and "outlet" refer to the direction of the priming fluid flow as compared to the direction of the working fluid flow associated with operation of the underlying pump assembly. Outlet end 106 is constructed to be sealingly secured to a pump housing such that outlet end 106 is fluidly connectable to the chamber associated with operation of the underlying pump. Like pump prime assembly 12, pump prime assembly 100 includes a cross-sectional area associated with outlet end 106 that is smaller than or less than the cross-sectional area associated with the opening of inlet end 104. Housing 102 extends in a generally inverted frusto-conical shape between the opening associated with inlet end 104 and the opening associated with outlet end 106. Housing 102 defines a volume or chamber 108 that is shaped to communicate the priming charge to the underlying pump and sufficient to contain a remaining priming charge. It should be appreciated that whereas housing 48 associated with pump prime assembly 12 includes the working fluid discharge opening 50, housing 102 of pump prime assembly 100 includes no such opening such that prime assembly 100 is configured to cooperate with underlying pump systems wherein the pump housing includes such a working fluid outlet. Alternatively, it is appreciated that housing 102 could include such a working fluid outlet and that such an outlet would be disposed nearer outlet end 106 than inlet end 104 with a valve assembly as described below disposed between such a working fluid outlet and the inlet end 104 of housing 102.

Unlike pump prime assembly 12, pump prime assembly 100 includes a valve arrangement 110 that is operable to selectively isolate passage of fluid beyond outlet end 106 from chamber 108 to the underlying pump assembly. Valve arrangement 110 includes an actuator 112 that is attached to a shaft 114 that operatively cooperates with a valve assembly 116. Alternate ends 118, 120 of shaft 114 are supported by housing 102 of pump prime assembly 100. An actuator 130, such as a handle, extends from housing 102 and is configured to be manipulated by the user so as to manipulate the orientation of valve assembly 116 between a sealed or closed and an unsealed or open valve configuration.

Figure 18:
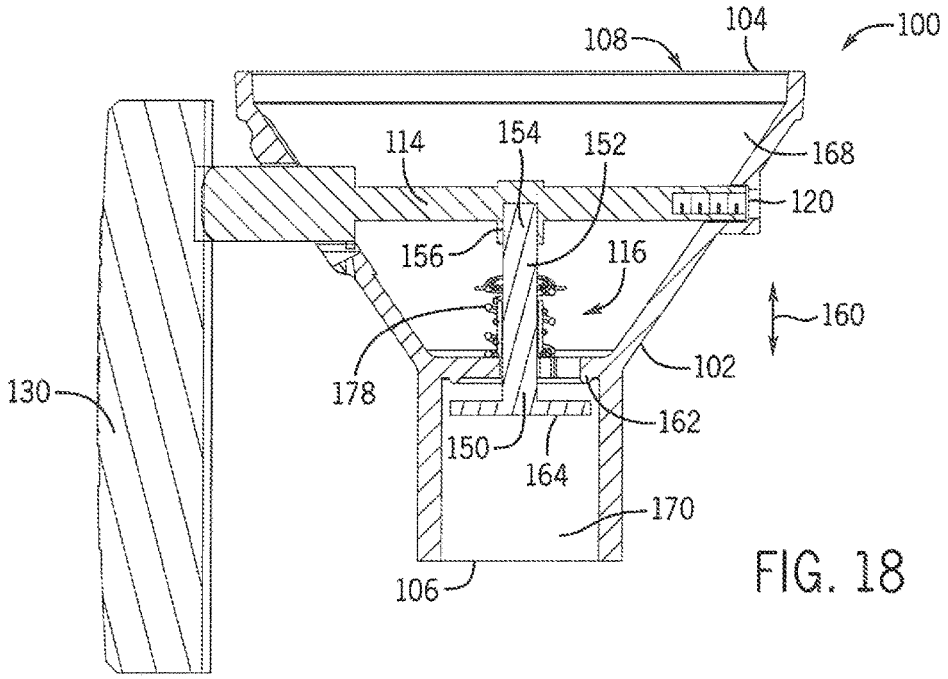
FIG. 18 is a partial cross section view of the priming assembly shown in FIG. 11 taken along line 18-18 shown in FIG. 17 and with an alternate handle associated with the valve assembly.
Figure 19:
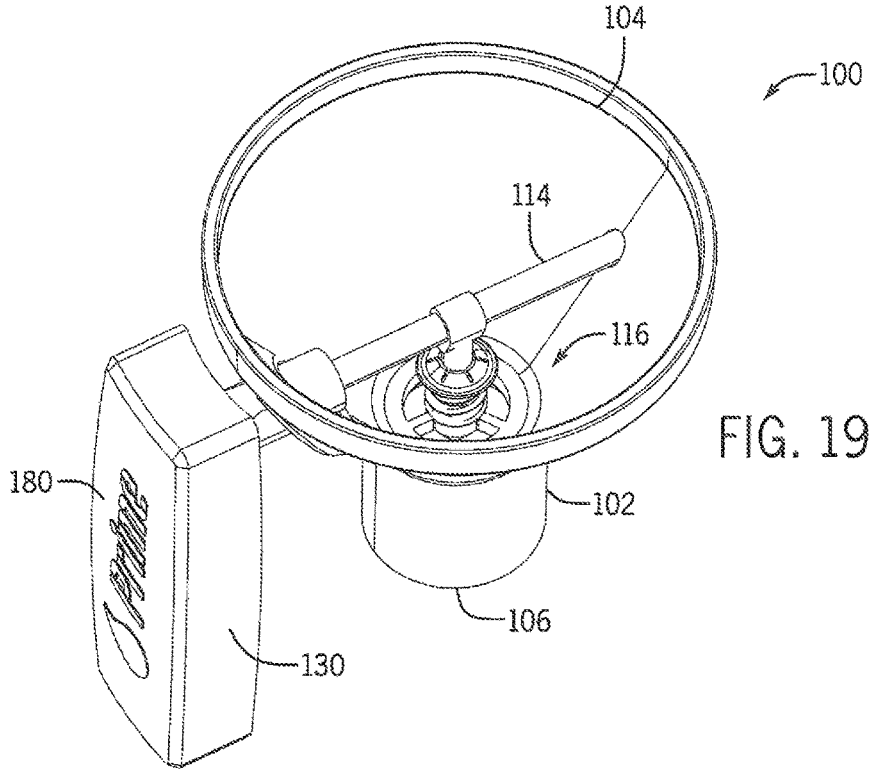
FIG. 19 is a perspective view of the priming assembly shown in FIG. 1*i* with the alternate handle associated with the valve assembly.
Figure 20:
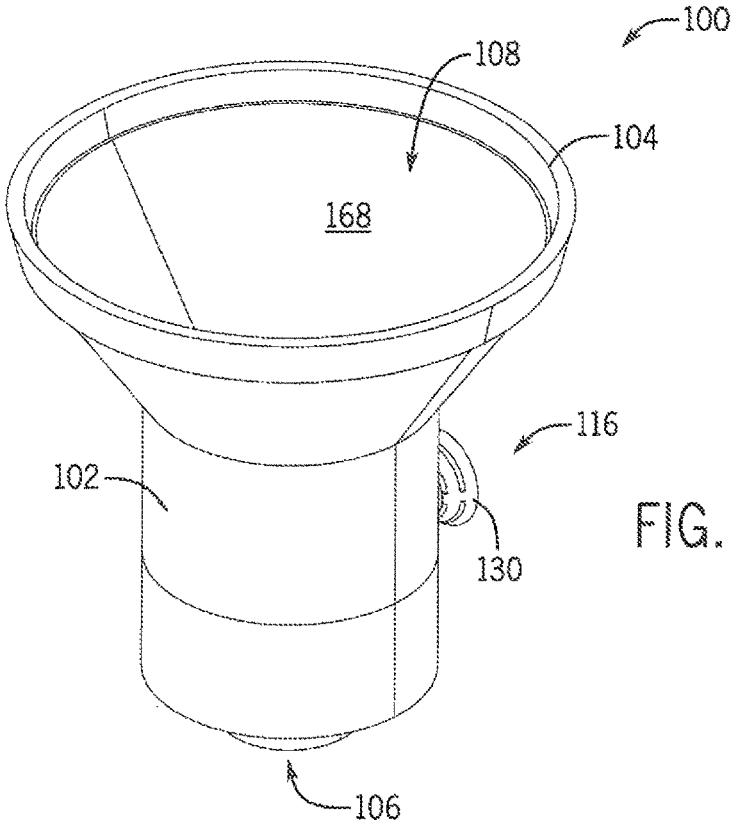
FIG. 20 is a perspective top view of the priming assembly shown in FIG. 11 with a valve assembly according to an alternate embodiment of the invention.
Figure 21:
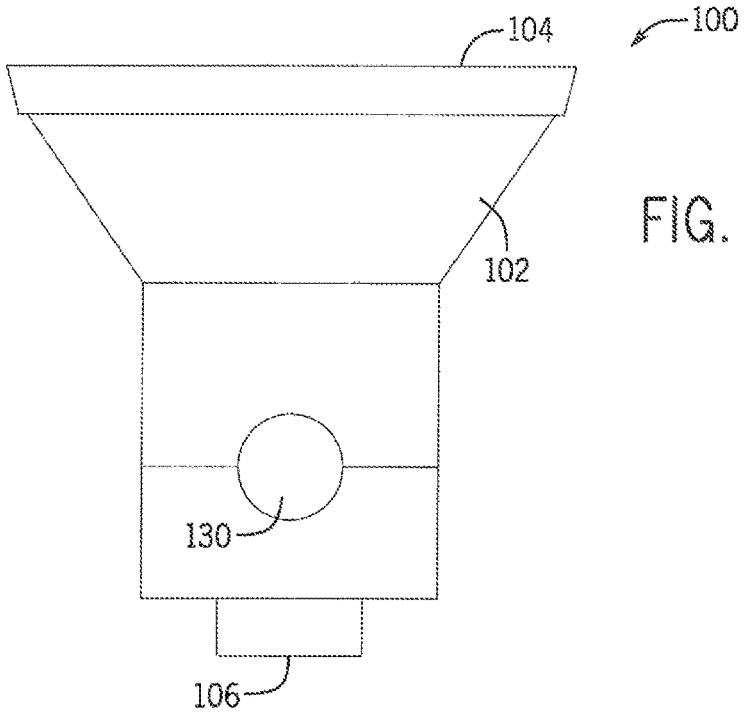
FIGS. 21-26 are side and plan views of the priming and valve assembly shown in FIG. 20.
Figure 22:
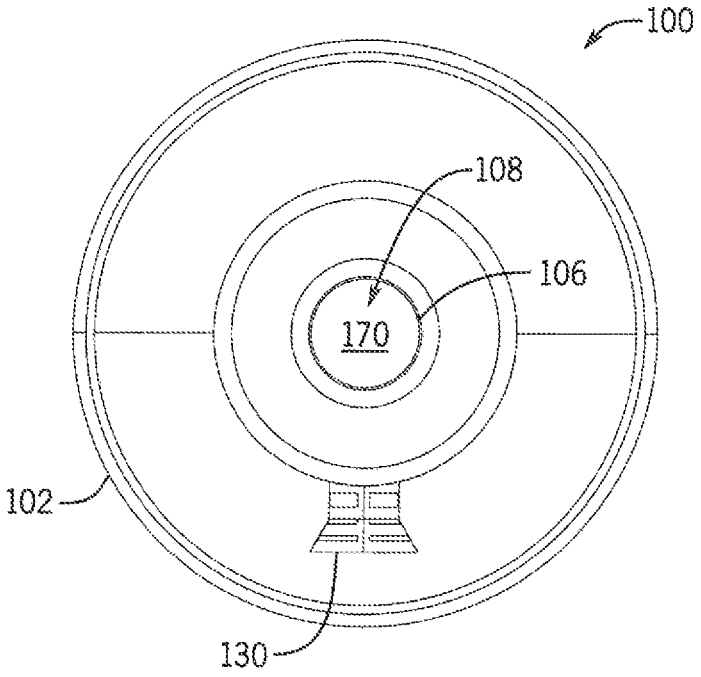
Figure 23:
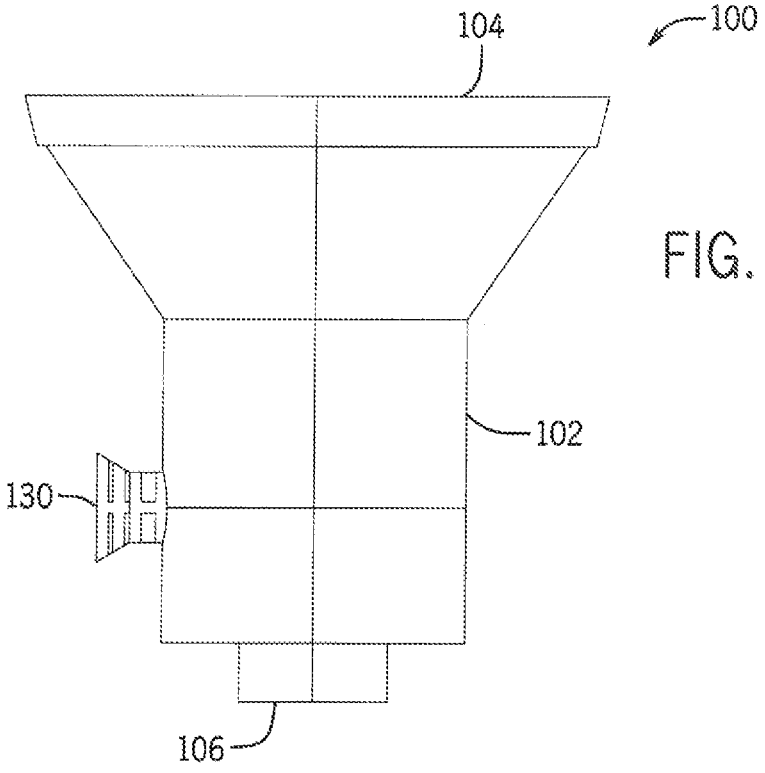
Figure 24:
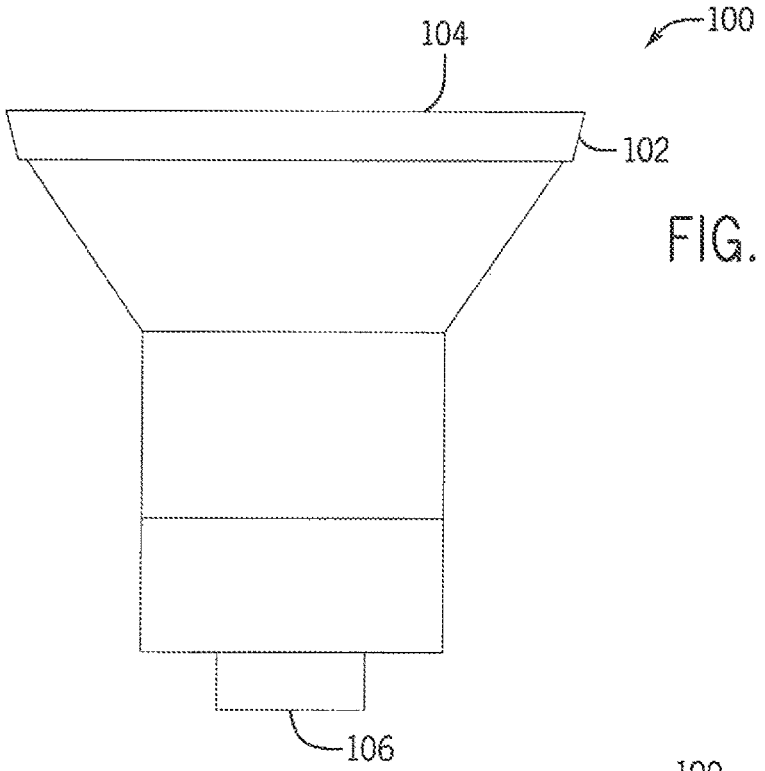
Figure 25:
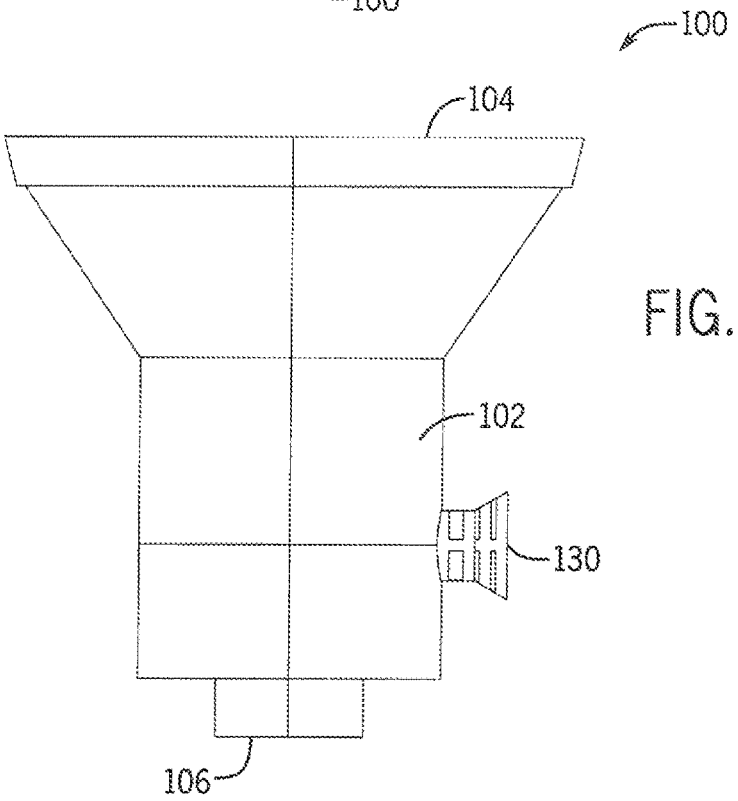
Figure 26:
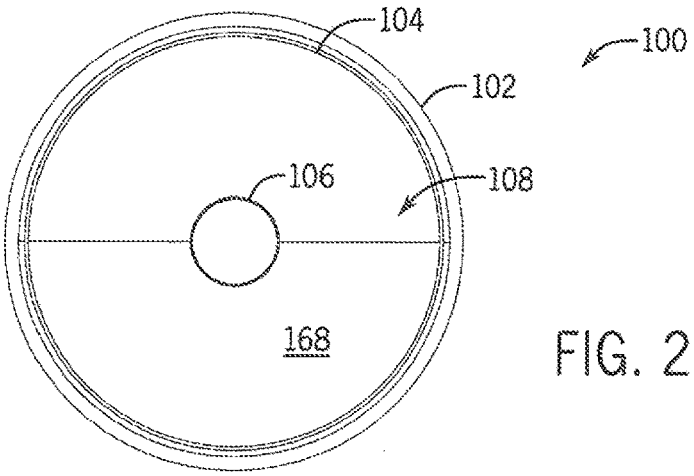
Figure 27:
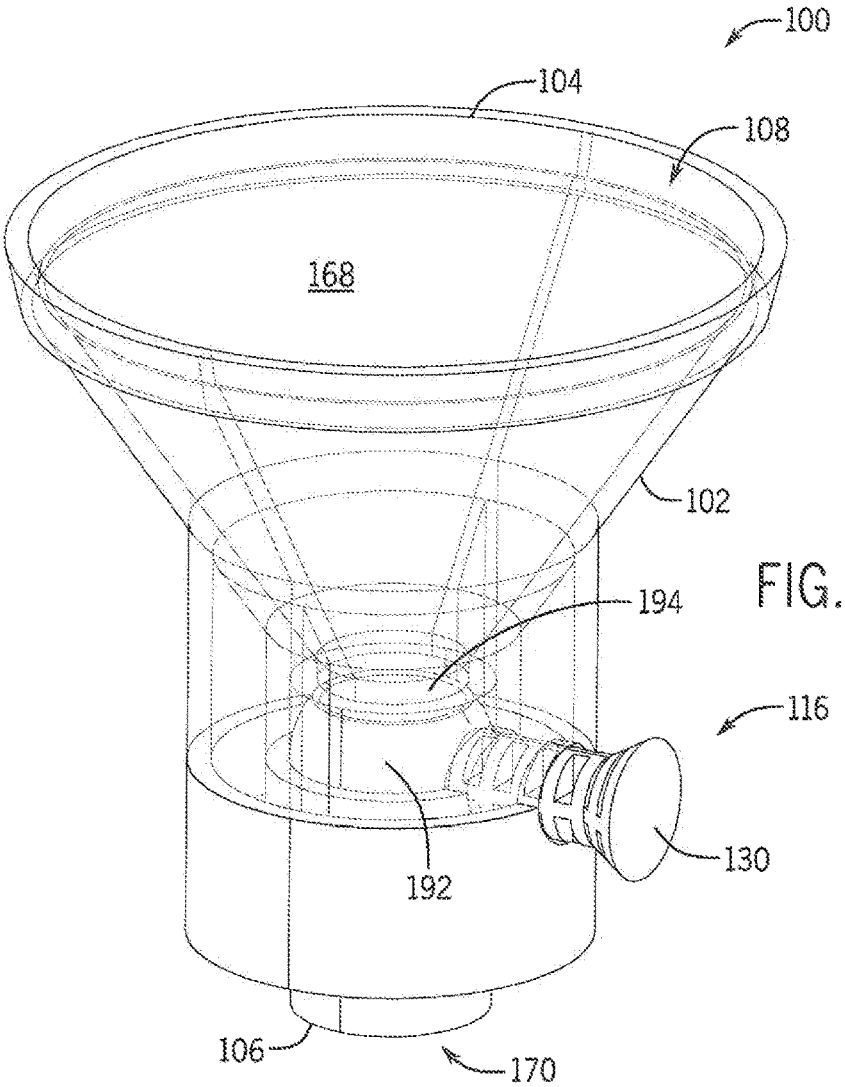
FIG. 27 is a partial section perspective view of the priming and valve assembly shown in FIG. 20.
Figure 28:
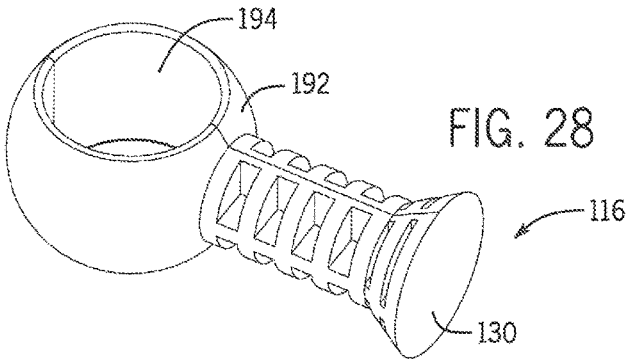
FIG. 28 is a perspective view of the valve assembly shown in FIG. 20 removed from the priming assembly housing.
Figure 29:
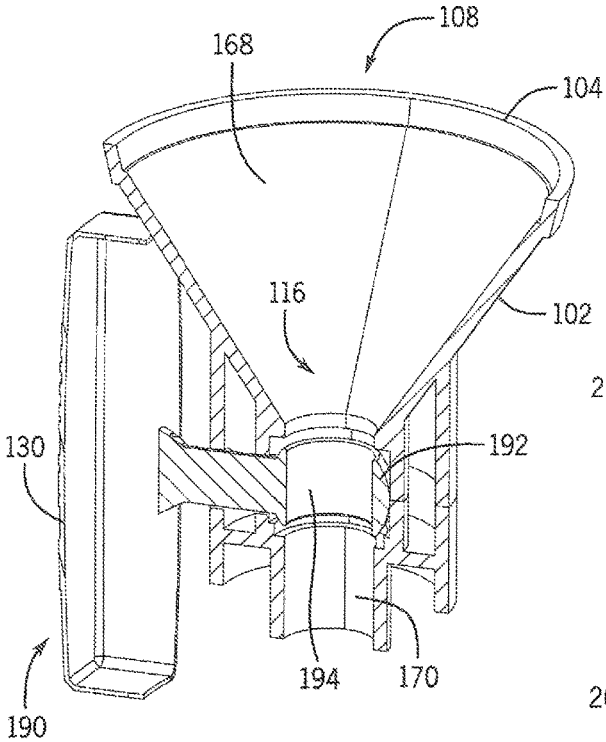
FIG. 29 is a perspective cross section view of the priming and valve assembly shown in FIG. 20 associated with a pump assembly with an alternate handle associated therewith.

Referring to FIGS. 18-19, valve assembly 116 includes a plunger 150 that is attached to a stem 152 that terminates in a distal end 154. Distal end 154 is slidably associated with a cam lobe 156 supported by shaft 114. Rotation of shaft 114 due to manipulation of the actuator or handle 130 effectuates rotation of lobe 156 relative to end 154 associated with stem 152 to effectuate vertical translation, indicated by arrow 160, of plunger 150 relative to a seat 162 associated with valve assembly 116. When open, a seal body 164 associated with plunger 150 is displaced from seat 162 so as to allow fluid communication between an upper portion 168 and a lower portion 170 of chamber 108. A biasing device, such as a spring 178 is associated with stem 152 of valve assembly 116 and configured to bias seal body 164 into engagement with seat 162 when lobe 156 is not otherwise aligned with end 154 of stem 152. Such consideration maintains valve assembly 116 in a generally closed configuration other than those instances where operator interaction with handle 130 manually opens valve assembly 116 to effectuate the priming process.

It is further appreciated that the sealed interaction associated with valve assembly 116 could be disposed at a lowermost end of pump prime assembly 100 such that the valve assembly selectively isolates the entirety of the volume defined by pump prime assembly from the fluid chamber or working fluid chamber defined by the underlying pump housing. Regardless of the relative position of the sealable features of valve assembly 116, the open orientation associated with valve assembly 116 allows passage of fluid introduced via the opening associated with inlet end 104 associated with pump prime assembly 100 to pass into the housing associated with an underlying pump. Upon completion of a priming process, operation of handle 130 in a closing direction disengages lobe 156 from end 154 of stem 152 thereby allowing seal body 164 to interact with seat 162 effectively fluidly isolating upper portion 168 associated with volume or chamber 108 from the working fluid path associated with operation of an underlying pump.

Referring to FIG. 19, handle 130 can include indicia 180 and/or be otherwise shaped, colored, or contoured to provide an indication as to the operation of the priming function associated with pump prime assembly 100.

Referring to FIGS. 20-29, in an alternate configuration valve assembly 116 is provided in a ball valve configuration 190. As is commonly understood, ball valve configuration 190 includes a ball portion 192 having an opening 194 that is formed therethrough. Ball portion 192 rotatably cooperates with housing 102 of pump prime assembly 100 and is rotatable to allow opening 194 to be aligned with portions 168, 170 of chamber 108 to allow fluid communication therebetween or to a transverse orientation such that the structure of ball portion 192 interferes with fluid communication between portion 168 and portion 170 associated with chamber 108. As is commonly understood, rotation of handle 130 approximately 45°, 90°, or any less than 360° of rotation can be used to effectuate the desired fluid connection and/or separation between respective portions 168, 170 associated with chamber 108.

Figure 30:
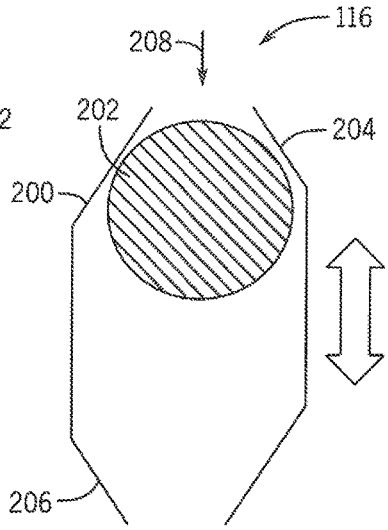
FIG. 30 is a schematic representation of another valve assembly usable with one or more of the priming assemblies shown herein.

Referring to FIG. 30, in yet a further alternate embodiment, valve assembly 116 associated with pump prime assembly 100 can include a priming flow passage or a chase 200 and a ball 202 that slidably cooperates therewith. Ball 202 is formed of a buoyant material and cooperates with alternate constrictions 204, 206 associated with passage of fluid, indicated by arrow 208, through chase 200. Once adequately primed, sufficient water is allowed to pass beyond ball 202 into the underlying pump housing assembly such that ball 202 is biased into engagement with constriction 204 so as to prevent fluid communication therebetween and egress of the priming fluid and working fluid once pump operation is achieved. When a prime condition is necessary, ball 202 translates in a downward direction relative to chase 200 thereby providing an indication as to an inadequate prime condition. Constrictions 204, 206 maintain the operative association of ball 202 with chase 200 whether a suitable or unsuitable prime condition has been achieved. It should be appreciated that the cross sectional size of chase 200 between constrictions 204, 206 is larger than the cross sectional shape of ball 202 such that the priming fluid can flow through chase 200 and around ball 202 until an adequate primed condition is achieved so as to seat ball 202 relative to constriction 204. Ball 202 remains seated against constriction 204 during self-sustained operation of the underlying pump assembly and thereby prevents egress of the working fluid flow via the priming assembly during operation of the underlying pump assembly.

It is further appreciated that each of the exemplary valve assemblies associated with prime assembly 100 effectuate selective fluid separation between the working fluid flow path and exposure to atmosphere associated with inlet end 104 whereas cover 54 provides a similar function associated with pump prime assembly 12. Accordingly, although not necessary for operation, pump prime assembly 100 could also be provided with a cap or cover associated with preventing the introduction of dirt or debris into upper portion 168 of chamber 108 associated with pump prime assembly 100. It should be appreciated that such a cap or cover would not necessarily need to be secured housing 102 in a manner wherein the cap and housing cooperate in a manner wherein the cap must withstand the operating pressure associated with operation of the underlying pump assembly.

It is further appreciated that one or more of the alternate valve assemblies 116 and/or pump prime assemblies as disclosed herein can be configured to communicate with an auto shutdown paradigm associated with operation of the underlying internal combustion engine and/or pump. For instance, it is appreciated that one or more of an electrical, electro-mechanical, or mechanical arrangements can be provided and/or associated with cover 54 and priming housing 48, and/or the respective valve assemblies 116 and/or actuators, and be configured to provide a signal and/or interact with the ignition, fuel, or motor operation systems associated with the underlying portable pump assembly to prevent and/or terminate operation of the underlying power plant a pump primed condition has been effectuated and/or is reestablished. Such a consideration prevents operation of the underlying pump went inadequate pump prime and/or working fluid flow conditions exist.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable those skilled in the art to utilize the invention.

We claim:

1. A priming assembly for use with a portable pump assembly including a pump received within a pump housing, the pump configured to pump fluid received at an input of the pump housing to an output of the pump housing, the priming assembly comprising:

a body having a first end operatively connectable to the output of the pump housing of the portable pump and a second end that is offset from the first end;

a chamber defined by the body and extending between the first end and the second end of the body, the chamber defining a cross-sectional area associated with the first end of the body that is less than a cross-sectional area of the chamber associated with the second end of the body; and a discharge tube having an input communicating with the chamber and an outlet isolated from the housing;

wherein the pump pumps fluid from the output of pump housing, through the chamber of the body and in the inlet of the discharge tube and out of the outlet of the discharge tube.

2. The portable pump priming assembly of claim 1 further comprising a cover that removably cooperates with the second end of the body.

3. The portable pump priming assembly of claim 2 wherein the cover threadably cooperates with the second end of the body.

4. The portable pump priming assembly of claim 1 further comprising an indicia associated with operation of the pump priming assembly wherein the indicia is formed on a cover.

5. The portable pump priming assembly of claim 1 wherein the body has a frustoconical shape.

6. The portable pump priming assembly of claim 1 further comprising a power plant connected to the pump housing configured to operate an impeller disposed therein.

7. A power driven pump assembly comprising:

a pump housing having a working fluid inlet and a working fluid outlet;

an impeller disposed in the pump housing and configured to communicate a working fluid along a working fluid path from the working fluid inlet toward the working fluid outlet during operation of the impeller;

a priming chamber having a priming passage inlet fluidically connected to the working fluid outlet and being configured to be in fluid communication with the working fluid path, the priming passage inlet having a larger cross section area than a priming passage outlet; and a discharge structure having an input fluidically communicating with the priming chamber and an outlet isolated from the pump housing, the working fluid allowed to flow through the discharge structure between the input and the outlet thereof.

8. The power driven pump assembly of claim 7 wherein the priming chamber is defined by a priming housing configured to sealingly cooperate with the pump housing.

9. The power driven pump assembly of claim 8 wherein the priming chamber is defined by the priming housing and the priming housing includes a second working fluid outlet.

10. A method of forming a power driven pump assembly, the method comprising:

providing a pump defined by a pump housing that defines a pump chamber and that substantially encloses an impeller configured to communicate a working fluid from a working fluid inlet to a working fluid outlet during operation of the impeller;

forming a priming charge passage that is configured to communicate a fluid priming charge to the pump chamber for priming the pump and that is defined by a priming charge inlet that has a larger cross section area than an outlet of the priming charge passage; and once the pump is primed, pumping the working fluid from the working fluid outlet, through the priming charge passage and out of a discharge outlet fluidically communicating with the priming charge passage and isolated from the pump chamber.

11. The method of claim 10 further comprising providing at least one of a cap that removably cooperates with the priming charge inlet.

12. The method of claim 11 further comprising providing an indicia on the cap wherein the indicia indicates a priming operation.

13. The method of claim 10 further comprising forming the priming charge passage with a priming housing configured to removably cooperate with the pump housing.

14. The method of claim 10 further comprising providing a power plant configured to drive the impeller of the pump during operation of the power plant.

* * * * *